US009812232B2

(12) United States Patent
Kibe et al.

(10) Patent No.: US 9,812,232 B2
(45) Date of Patent: Nov. 7, 2017

(54) ELECTRIC WIRE AND CABLE

(71) Applicant: Hitachi Metals, Ltd., Tokyo (JP)

(72) Inventors: Tamotsu Kibe, Hitachi (JP); Hisao Furuichi, Hitachi (JP); Hiroshi Okikawa, Hitachi (JP); Ryutaro Kikuchi, Mito (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/934,807

(22) Filed: Nov. 6, 2015

(65) Prior Publication Data

US 2016/0141077 A1 May 19, 2016

(30) Foreign Application Priority Data

Nov. 13, 2014 (JP) ..... 2014-231104

(51) Int. Cl.

| | |
|---|---|
| ***H01B 7/00*** | (2006.01) |
| ***H01B 7/295*** | (2006.01) |
| ***H01B 3/44*** | (2006.01) |
| ***H01B 1/02*** | (2006.01) |
| ***H01B 7/04*** | (2006.01) |

(52) U.S. Cl.

CPC ..... *H01B 7/295* (2013.01); *H01B 1/026* (2013.01); *H01B 3/445* (2013.01); *H01B 3/446* (2013.01); *H01B 7/0009* (2013.01); *H01B 7/04* (2013.01)

(58) Field of Classification Search

USPC .... 174/110 R, 110 A–110 PM, 120 R, 121 R

See application file for complete search history.

(56) References Cited

U.S. PATENT DOCUMENTS

| | | | | | |
|---|---|---|---|---|---|
| 3,260,694 | A | * | 7/1966 | Wang | C08K 5/14 174/110 PM |
| 3,553,348 | A | * | 1/1971 | Betts | C08K 5/14 174/110 PM |
| 3,735,025 | A | * | 5/1973 | Ling | H01B 1/24 174/102 SC |
| 3,944,717 | A | * | 3/1976 | Hacker | H01B 13/22 106/18.23 |
| 4,005,254 | A | * | 1/1977 | MacKenzie, Jr. | B29C 35/065 174/110 PM |

(Continued)

FOREIGN PATENT DOCUMENTS

| | | | | | |
|---|---|---|---|---|---|
| EP | 0630941 | A | * | 5/1994 | C08L 51/00 |
| EP | 1655740 | A | * | 5/2006 | H01B 13/00 |

(Continued)

*Primary Examiner* — William H Mayo, III

(74) *Attorney, Agent, or Firm* — McGinn IP Law Group, PLLC.

(57) ABSTRACT

An electric wire includes a conductor having a cross-sectional area of not less than 180 $mm^2$ and not more than 220 $mm^2$, an insulation provided so as to cover the outer periphery of the conductor, and a wire sheath provided so as to cover the outer periphery of the insulation. The amount of deflection is not less than 180 mm when, at 23° C., one end of the electric wire is fixed to a fixture table so that another end horizontally protrudes 400 mm from the fixture table and a weight of 2 kg is attached to the other end, and cracks and breaks do not occur when wound with a bending diameter of three times the diameter at −40° C.

13 Claims, 4 Drawing Sheets

(56) References Cited

U.S. PATENT DOCUMENTS

| | | | | | |
|---|---|---|---|---|---|
| 4,062,998 | A * | 12/1977 | Hagiwara | H01B 3/443 | 174/120 C |
| 4,789,589 | A * | 12/1988 | Baxter | H01B 7/0233 | 174/110 F |
| 4,945,191 | A * | 7/1990 | Satsuka | H01B 3/421 | 174/120 SR |
| 5,036,121 | A * | 7/1991 | Coaker | H01B 3/443 | 174/110 V |
| 5,473,007 | A * | 12/1995 | Kwon | C08F 255/023 | 524/404 |
| 6,801,421 | B1 * | 10/2004 | Sasse | H01F 29/146 | 174/102 SC |
| 2010/0084181 | A1 * | 4/2010 | Sorimachi | C08K 5/0008 | 174/388 |
| 2010/0096162 | A1 * | 4/2010 | Cerra | H01B 7/0009 | 174/126.2 |
| 2015/0284528 | A1 * | 10/2015 | Galletti | C08J 11/06 | 174/103 |

FOREIGN PATENT DOCUMENTS

| | | | | |
|---|---|---|---|---|
| JP | 60-168745 | * | 9/1985 | C08K 3/22 |
| JP | 11-329101 A | | 11/1999 | |

* cited by examiner

ELECTRIC WIRE AND CABLE

The present application is based on Japanese patent application No. 2014-231104 filed on Nov. 13, 2014, the entire contents of which are incorporated herein by reference.

BACKGROUND OF THE INVENTION

1. Field of the Invention

The invention relates to an electric wire and a cable.

2. Description of the Related Art

As interior and exterior wirings of buildings or main lines of distribution boards or power control panels, etc., for example, cross-linked polyethylene insulated cables with vinyl sheath (hereinafter, referred to as "CV cables") are used. CV cables are excellent in electrical characteristics, light in weight and easy to handle, and thus have been widely used as power cables.

For example, a CV cable as disclosed in JP-A-H11-329101 has been developed.

SUMMARY OF THE INVENTION

Thicker wires/cables are more rigid and more difficult to bend. Thus, the thicker wires/cables have a larger allowable bending radius. The wires/cables with the large allowable bending radius need a wider wiring space and may thus be difficult to wire in a narrow space. In addition, if the rigid wires/cables are bent extremely, they may be damaged at the bent portion and may deteriorate in cable performance. This tendency may be more prominent if the wires/cables are thicker and temperature of use environment is lower.

It is an object of the invention to provide an electric wire and a cable each with improved flexibility and low-temperature bending properties.

According to an embodiment of the invention, an electric wire comprises:

a conductor having a cross-sectional area of not less than 180 $mm^2$ and not more than 220 $mm^2$;

an insulation provided so as to cover the outer periphery of the conductor; and a wire sheath provided so as to cover the outer periphery of the insulation, wherein the amount of deflection is not less than 180 mm when, at 23° C., one end of the electric wire is fixed to a fixture table so that another end horizontally protrudes 400 mm from the fixture table and a weight of 2 kg is attached to the other end, and cracks and breaks do not occur when wound with a bending diameter of three times the diameter at −40° C.

According to another embodiment of the invention, a cable comprises a plurality of the electric wires according to the above that are twisted together.

Effects of the Invention

According to an embodiment of the invention, an electric wire and a cable each with improved flexibility and low-temperature bending properties can be provided.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

First Embodiment of the Invention

(1) Electric Wire

Figure 1:
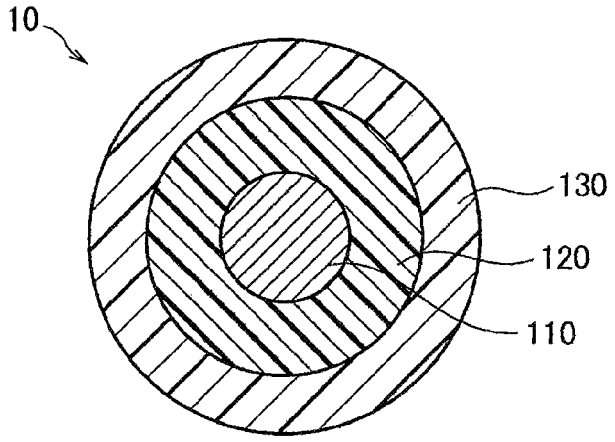
FIG. 1 is a cross sectional view orthogonal to an axial direction, showing an electric wire in a first embodiment of the present invention.

An electric wire in the first embodiment of the invention will be described in reference to FIG. 1. FIG. 1 is a cross sectional view orthogonal to an axial direction, showing an electric wire in the first embodiment.

Figure 2A:
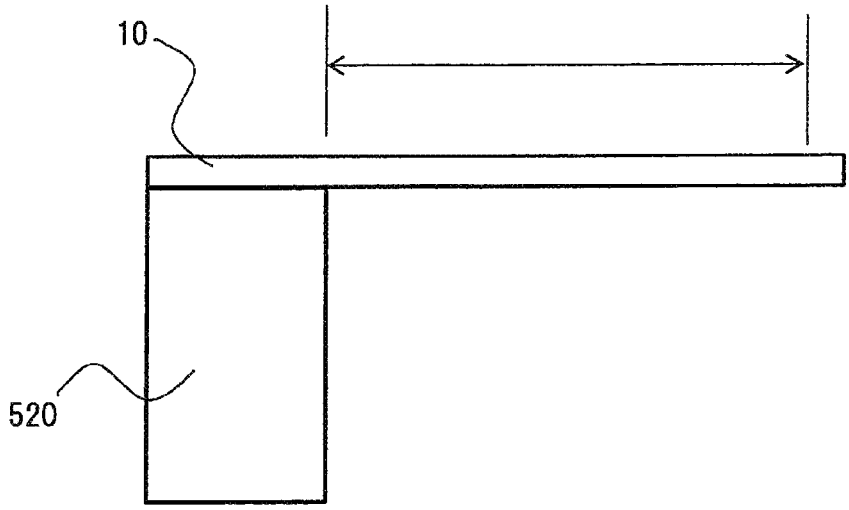
FIGS. 2A and 2B are schematic side views showing a deflection test.
Figure 2B:
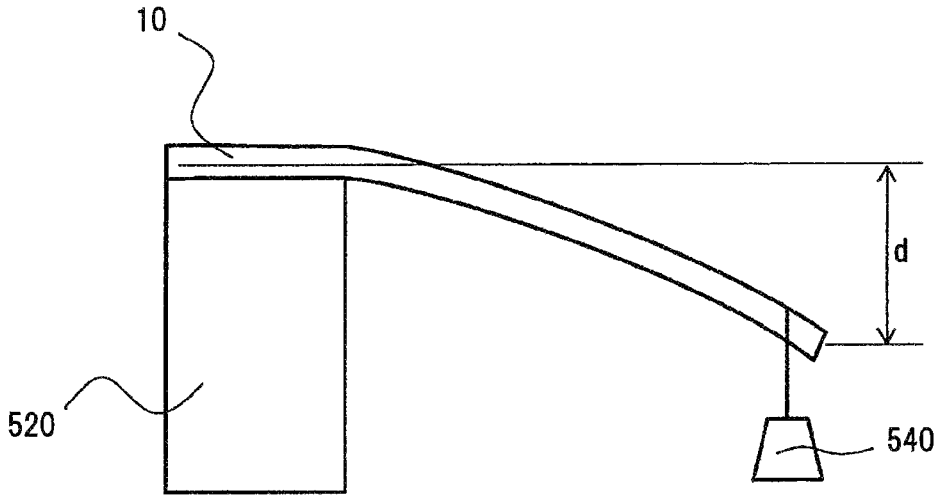

As shown in FIG. 1, an electric wire 10 in the first embodiment has a conductor 110, an insulation 120 provided so as to cover the outer periphery of the conductor 110, and a wire sheath 130 provided so as to cover the outer periphery of the insulation 120. The cross-sectional area of the conductor 110 is, e.g., 200 $mm^2$±10%, i.e., not less than 180 $mm^2$ and not more than 220 $mm^2$ As a result of intense study by the present inventors, the electric wire 10 exhibiting the below-described predetermined characteristics in a deflection test and a low-temperature bend test was achieved for the first time ever when the cross-sectional area of the conductor 110 is not less than 180 $mm^2$ and not more than 220 $mm^2$ The deflection test in the first embodiment will be described in reference to FIGS. 2A and 2B. FIGS. 2A and 2B are schematic side views showing the deflection test. The deflection test is conducted under the condition of room temperature (23° C.). Firstly, one end of the electric wire 10 is fixed to a fixture table 520 so that another end horizontally protrudes 400 mm from the fixture table 520 (a fulcrum point), as shown in FIG. 2A. Then, as shown in FIG. 2B, a weight 540 of 2 kg is attached to the other end of the electric wire 10 and the amount of deflection (d) after 30 seconds is measured. The amount of deflection (d) is obtained as a vertical distance from the position of the central axis of the electric wire 10 on the fixture table 520 to the position of the central axis of the other end of the deflected electric wire 10.

The amount of deflection of the electric wire 10 in the first embodiment is, e.g., not less than 180 mm in the deflection test.

Next, the low-temperature bend test in the first embodiment will be described. In the low-temperature bend test, the electric wire 10 is wound with a bending diameter of three times the diameter of the electric wire 10 under the condition of −40° C. For example, the electric wire 10 is wound one turn around a column having a diameter of three times the diameter of the electric wire 10. Next, the electric wire 10 is visually observed for presence of cracks or breaks. At this time, the wire fails the test when cracks or breaks are visually observed on the bent portion, and the wire passes the test when the state of the bend portion is visually indistinguishable from the other straight portion. On the wire which failed the low-temperature bend test, cracks or breaks of, e.g., not less than 5 mm may occur at the bent portion.

On the electric wire 10 in the first embodiment, cracks or breaks do not occur in such a low-temperature bend test.

Configuration of Electric Wire

The following is an example configuration of the electric wire 10 which exhibits predetermined characteristics in the deflection test and the low-temperature bend test described above.

Conductor

The conductor 110 has plural strands. The strand is formed of oxygen-free copper or copper alloy or is a copper-clad wire, etc., and is exemplarily formed of oxygen-free copper. The surface of the strand may be plated with tin, silver or nickel, etc. In the first embodiment, the strand is, e.g., a tin-plated soft copper wire.

The diameter of the strand is, e.g., not more than 0.46 mm. When the diameter of the strand is more than 0.46 mm, deflection of electric wire may not be sufficient, causing an increase in the allowable bending radius of the electric wire. In contrast, use of the strand having a diameter of not more than 0.46 mm improves flexibility of the electric wire 10 and thus allows the electric wire 10 to have a small allowable bending radius. In the first embodiment, the diameter of the strand is, e.g., 0.45 mm. In this respect, when the diameter of the strand is 0.45 mm, tolerance on strand diameter in the JIS standard is 0.45±0.01 mm In the conductor 110, for example, each child twisted wire (primary twisted wire) is formed by twisting not less than thirty-four strands together and a parent twisted wire (a secondary twisted wire) is formed by twisting not less than thirty-seven child twisted wires together. The parent twisted wire is the conductor 110. In the first embodiment, exemplarily, the number of the strands forming the child twisted wire is, e.g., thirty-four and the number of the child twisted wires forming the parent twisted wire is thirty-seven.

In the first embodiment, for example, the child twisted wire is a bunch-stranded wire and the parent twisted wire is a concentric-stranded wire. The bunch stranding here is a twisting method in which plural strands (or twisted wires) are twisted all together in the same direction. Meanwhile, the concentric stranding is a twisting method in which plural strands (or twisted wires) are concentrically twisted around one or plural strands (or twisted wires). The twisted wire formed by bunch stranding is excellent in flexibility but the strands (or twisted wires) may unravel and this may have an effect on electrical characteristics of the electric wire. Based on this, in the first embodiment, the child twisted wires are formed by bunch stranding and the parent twisted wire by concentric stranding. In this configuration, concentric stranding of the parent twisted wire prevents the strands of the child twisted wires from unraveling. Therefore, it is possible to obtain both flexibility of the conductor 110 and electrical characteristics of the electric wire 10.

The cross-sectional area of the conductor 110 having such a configuration is not less than 180 $mm^2$ and not more than 220 $mm^2$, as described above. The outer diameter of the conductor 110 (the outer diameter of the finished conductor) in this case is, e.g., 21.2 mm±10%, i.e., not less than 19.1 mm and not more than 23.3 mm. In the first embodiment, the outer diameter of the conductor 110 is, e.g., 21.2 mm Insulation and Wire Sheath The insulation 120 and the wire sheath 130 in the first embodiment are configured to have a predetermined hardness. In detail, the insulation 120 and the wire sheath 130 have a Shore A hardness of, e.g., not more than 88. By forming the conductor 110 to have the above-mentioned configuration and configuring the insulation 120 and the wire sheath 130 to have the above-defined hardness, it is possible to realize the electric wire 10 exhibiting predetermined characteristics in the deflection test and the low-temperature bend test.

The following is an example configuration of the insulation 120 and the wire sheath 130 which have a Shore A hardness of not more than 88. The below-described configuration of the insulation 120 and the wire sheath 130 allows the electric wire 10 in the first embodiment not only to exhibit the predetermined characteristics in the deflection test and the low-temperature bend test described above, but also to have excellent flame retardancy, heat resistance and elongation characteristics.

Base Resin

The insulation 120 and the wire sheath 130 are formed of a resin composition in which a base resin contains a chlorinated polyethylene (CPE) and a polyolefin resin other than the CPE.

The chlorine content in the CPE contained in the base resin is, e.g., not less than 30% and not more than 45%, exemplarily, not less than 35% and not more than 40%. When the chlorine content in the CPE is less than 30%, hardness of the insulation and wire sheath is greater than a predetermined hardness and also flame retardancy of the electric wire may decrease. In contrast, in the first embodiment in which the chlorine content in the CPE is not less than 30%, it is possible to provide the flexible insulation 120 and wire sheath 130 having not more than the predetermined hardness and it is also possible to improve flame retardancy of the electric wire 10. Furthermore, at the chlorine content of not less than 35% in the CPE, it is possible to further improve flexibility and flame retardancy of the electric wire 10. On the other hand, when the chlorine content in the CPE is more than 45%, heat resistance of the electric wire may not be sufficient. In contrast, in the first embodiment in which the chlorine content in the CPE is not more than 45%, it is possible to improve heat resistance of the electric wire 10. Furthermore, at the chlorine content of not more than 40% in the CPE, it is possible to further improve heat resistance of the electric wire 10.

When the entire base resin is 100 parts by weight, the CPE content in the base resin is, e.g., not less than 20 parts by weight and not more than 60 parts by weight. When the CPE content is less than 20 parts by weight, elongation characteristics (flexibility) of the electric wire tend to be low and flame retardancy of the electric wire may not be sufficient. In contrast, in the first embodiment in which the CPE content is not less than 20 parts by weight, it is possible to improve elongation characteristics as well as flame retardancy of the electric wire 10. The CPE content of not less than 30 parts by weight is more exemplary. In this case, it is possible to further improve elongation characteristics and flame retardancy of the electric wire 10. On the other hand, when the CPE content is more than 60 parts by weight, heat resistance of the electric wire may not be sufficient. In contrast, in the first embodiment in which the CPE content is not more than 60 parts by weight, it is possible to improve heat resistance of the electric wire 10. The CPE content of not more than 40 parts by weight is more exemplary. In this case, it is possible to further improve heat resistance of the electric wire 10.

The CPE in the base resin can be one CPE alone or a mixture of two or more types of CPEs. In addition, the CPE in the base resin can be any of amorphous, semi-crystalline or crystalline CPEs.

The base resin contains 100 parts by weight in total of the above-mentioned CPE in an amount of not less than 20 parts by weight and not more than 60 parts by weight and a polyolefin resin other than the CPE. In other words, the polyolefin resin other than the CPE is contained in an amount of not less than 40 parts by weight and not more than 80 parts by weight.

Examples of the polyolefin resin other than the CPE include low-density polyethylene (LDPE), linear low-density polyethylene (LLDPE), linear very low density polyethylene (VLDPE), high-density polyethylene (HDPE), polypropylene (PP), ethylene-ethyl acrylate copolymer (EEA), ethylene-vinyl acetate copolymer (EVA), ethylene-glycidyl methacrylate copolymer, ethylene-butene-1 copolymer, ethylene-butene-hexene terpolymer, ethylene-propylene-diene terpolymer (EPDM), ethylene-octene copolymer (EOR), ethylene copolymerized polypropylene, ethylene-propylene copolymer (EPR), poly-4-methyl-pentene-1, maleic acid grafted low density polyethylene, hydrogenated styrene-butadiene copolymer (H-SBR), maleic acid grafted linear low density polyethylene, a copolymer of ethylene and α-olefin having 4 to 20 carbon atoms, ethylene-styrene copolymer, maleic acid grafted ethylene methyl acrylate copolymer, maleic acid grafted ethylene vinyl acetate copolymer, ethylene-maleic anhydride copolymer, ethylene-ethyl acrylate-maleic anhydride terpolymer, and ethylene-propylene-butene-1 terpolymer consisting mainly of butene-1, etc. These polyolefin resins can be used alone or as a mixture of two or more thereof.

Exemplarily, the polyolefin resin is EVA. EVA is a low-crystalline polymer and thus allows the electric wire 10 to have flexibility. More exemplarily, the polyolefin resin is EVA with a VA content of not less than 25% and not more than 35%. When the VA content in EVA is less than 25%, crystallinity level of the EVA is close to that of polyethylene and hardness of the insulation and the wire sheath may become greater than a predetermined hardness. In contrast, in the first embodiment in which the VA content in EVA is not less than 25%, crystallinity level of EVA is low and it is thus possible to provide the flexible insulation 120 and wire sheath 130 having not more than the predetermined hardness. On the other hand, when the VA content in EVA is more than 35%, strength and heat resistance of the electric wire may decrease. In contrast, in the first embodiment in which the VA content in EVA is not more than 35%, it is possible to suppress a decrease in strength and heat resistance of the electric wire 10.

Stabilizer

The resin composition constituting the insulation 120 and the wire sheath 130 contains a stabilizer formed of, e.g., hydrotalcite. Hydrotalcite of the stabilizer serves as an acid neutralizer. The hydrotalcite used in the first embodiment is, e.g., $Mg_6Al_2(CO_3)(OH)_{16}.4(H_2O)$. The average particle size of the hydrotalcite when it is, e.g., a synthetic compound is not less than 1 μm and not more than 5 μm. In the first embodiment, the average particle size is a particle diameter at 50% in the cumulative particle size distribution derived from laser diffraction/scattering method.

The content of the hydrotalcite as a stabilizer is, e.g., not less than 3 parts by weight and not more than 30 parts by weight per 100 parts by weight of the base resin. When the hydrotalcite content is less than 3 parts by weight, heat resistance of the electric wire may decrease. In contrast, in the first embodiment in which the hydrotalcite content is not less than 3 parts by weight, it is possible to improve heat resistance of the electric wire 10. On the other hand, when the hydrotalcite content is more than 30 parts by weight, elongation characteristics of the electric wire may decrease. In contrast, since the hydrotalcite content is not more than 30 parts by weight, it is possible to improve elongation characteristics of the electric wire 10.

Flame Retardant

The resin composition constituting the insulation 120 and the wire sheath 130 contains, e.g., a flame retardant. The flame retardant is, e.g., antimony trioxide. The average particle size of the antimony trioxide is, e.g., not less than 1 μm and not more than 5 μm.

When the resin composition contains antimony trioxide as a flame retardant, the antimony trioxide content is, e.g., not less than 1 part by weight and not more than 5 parts by weight per 100 parts by weight of the base resin. When the antimony trioxide content is less than 1 parts by weight, the effect of the flame retardant to improve flame retardancy may not be obtained. In contrast, in the first embodiment in which the antimony trioxide content is not less than 1 part by weight, the effect of improving flame retardancy can be exerted. On the other hand, when the antimony trioxide content is more than 5 parts by weight, hardness of the insulation and wire sheath may become greater than a predetermined hardness. In contrast, since the antimony trioxide content is not more than 5 parts by weight, it is possible to provide the flexible insulation 120 and wire sheath 130 having not more than the predetermined hardness.

Examples of other flame retardants include magnesium hydroxide, aluminum hydroxide, calcium hydroxide, amorphous silica, zinc compound such as zinc hydroxystannate, zinc borate and zinc oxide, borate compound such as calcium borate, barium borate or barium metaborate, phosphorous flame retardant, intumescent flame retardant formed by mixing a component expanding when burnt with a component being solidified when burnt, bromine flame retardant and chlorine flame retardant. These flame retardants can be used alone or as a mixture of two or more thereof.

Other Additives

To the resin composition constituting the insulation 120 and the wire sheath 130, it is possible, if necessary, to add additives such as antioxidant, metal deactivator, cross-linking agent, crosslinking aid, lubricant, inorganic filler, compatibilizing agent and colorant, etc., in addition to the materials listed above. In addition, the resin composition may be cross-linked by an electron beam.

Examples of antioxidant include phenol antioxidant, sulfur antioxidant, amine antioxidant and phosphorus antioxidant, etc.

Examples of phenol antioxidant include dibutylhydroxytoluene (BHT), pentaerythritol tetrakis[3-(3,5-di-t-butyl-4-hydroxyphenyl)propionate], 1,3,5-tris(3,5-di-t-butyl-4-hydroxybenzyl)-s-triazine-2,4,6(1H,3H,5H)trione and thiodiethylene bis[3-(3,5-di-tert-butyl-4-hydroxyphenyl) propionate], etc. Exemplarily, the phenol antioxidant is pentaerythritol tetrakis[3-(3,5-di-t-butyl-4-hydroxyphenyl) propionate].

Examples of sulfur antioxidant include didodecyl 3,3'-thiodipropionate, ditridecyl 3,3'-thiodipropionate, dioctadecyl 3,3'-thiodipropionate and tetrakis[methylene-3-(dodecylthio)propionate]methane, etc. Exemplarily, the sulfur antioxidant is tetrakis[methylene-3-(dodecylthio)propionate]methane.

Examples of amine antioxidant include 6-ethoxy-1,2,-dihydro-2,2,4-trimethylquinoline, phenyl-1-naphthylene, alkylated diphenylamine, octylated diphenylamine, 4,4'-bis (α,α-dimethylbenzyl)diphenylamine, 2,2,4-trimethyl-1,2-dihydroquinoline polymer, p-(p-toluenesulfonyl amido)diphenylamine, N,N'-di-2-naphthyl-p-phenyldiamine, N,N'-diphenyl-p-phenylenediamine, N-phenyl-N'-isopropyl-p-phenylenediamine, N-phenyl-N'-(1,3-dimethylbutyl)-p-phenylenediamine, N-phenyl-N'-(3-methacryloyloxy-2-hydroxypropyl)-p-phenylenediamine, 1,3-benzenedicarboxylic acid bis[2-(1-oxo-2-phenoxypropyl) hydrazide], 2'-,3-bis[3-[3,5-di-tert-butyl-4-hydroxyphenyl] propionyl]]propionohydrazide, 3-(N-salicyloyl)amino-1H-1,2,4-triazole and dodecanedioic acid bis[N2-(2-hydroxybenzoyl)hydrazide], etc.

The metal deactivator has an effect of inhibiting oxidation degradation by chelating metal ions. Examples of the metal deactivator include N-(2H-1,2,4-triazol-5-yl)salicylamide, dodecanedioic acid bis[N2-(2-hydroxybenzoyl)hydrazide] and 2',3-bis[3-[3,5-di-tert-butyl-4-hydroxyphenyl]propionyl]]propionohydrazide, etc. Exemplarily, the metal deactivator is 2',3-bis[3-[3,5-di-tert-butyl-4-hydroxyphenyl]propionyl]]propionohydrazide.

The cross-linking agent used is e.g., organic peroxide, and specific examples thereof include peroxyketal, dialkyl peroxide, diacyl peroxide and peroxyester, etc. Exemplarily, the cross-linking agent is diacyl peroxide. The amount of the cross-linking agent contained is not less than 0.1 parts by weight and not more than 3 parts by weight, exemplarily not less than 0.5 parts by weight and not more than 1 part by weight, per 100 parts by weight of the base resin.

Examples of the crosslinking aid include trimethylolpropane trimethacrylate (TMPT) and triallyl isocyanurate (TAIC), etc.

Examples of the lubricant include fatty acid, fatty acid metal salt and fatty acid amide, etc. A specific example of the lubricant is, e.g., zinc stearate. These lubricants can be used alone or as a mixture of two or more thereof.

Examples of the inorganic filler include clay, talc, silica and calcium carbonate, etc. These inorganic fillers may be surface-treated with a surface treatment agent such as fatty acid or silane. These inorganic fillers can be used alone or as a mixture of two or more thereof.

Example of the colorant includes carbon black. The carbon black is, e.g., carbon black to be used in rubber (N900-N100: ASTM D1765-01).

Example of other colorants includes color masterbatch, etc.

The insulation 120 and the wire sheath 130 are formed of the resin composition described above. For example, a colorant such as carbon black is not contained in the resin composition constituting the insulation 120 but is contained in the resin composition constituting the wire sheath 130. In the first embodiment, the components and proportions for the resin composition constituting the wire sheath 130, except a colorant such as carbon black, are the same as those for the resin composition constituting the insulation 120.

The insulation 120 configured as described above has a thickness of, e.g., not less than 1.5 mm and not more than 3.5 mm. In the first embodiment, the thickness of the insulation 120 is, e.g., 2.5 mm Meanwhile, the wire sheath 130 configured as described above has a thickness of, e.g., not less than 1 mm and not more than 3 mm. In the first embodiment, the thickness of the wire sheath 130 is, e.g., 1.9 mm The electric wire 10 in the first embodiment configured as described above has a allowable bending radius of, e.g., not less than 80 mm and not more than 150 mm. On the other hand, a conventional CV cable having a cross-linked polyethylene insulation and a polyvinyl chloride wire sheath has a allowable bending radius of not less than 208 mm if the CV cable has the same shape and structure as the electric wire 10 in the first embodiment except the configuration of the conductor and the materials for forming the insulation and the wire sheath. Thus, the electric wire 10 in the first embodiment has a smaller allowable bending radius than the conventional CV cable.

(2) Method of Manufacturing Electric Wire

Next, a method of manufacturing the electric wire in the first embodiment will be described.

Conductor Forming Step

Firstly, a predetermined number of strands each having a diameter of not more than 0.46 mm are prepared. Next, not less than thirty-four strands are bunch-stranded into a child twisted wire. Next, not less than thirty-seven child twisted wires are concentrically stranded into a parent twisted wire. This parent twisted wire is the conductor 110.

Kneading Step

The respective predetermined amounts of a base resin containing a chlorinated polyethylene and a polyolefin resin other than the chlorinated polyethylene, a stabilizer formed of hydrotalcite, a flame retardant such as antimony trioxide and other additives except a cross-linking agent are mixed and kneaded by a pressure kneader at a predetermined temperature for a predetermined period of time. Next, a cross-linking agent is added and the mixture is then kneaded at a predetermined temperature for a predetermined period of time. Next, the kneaded mixture is formed into a pellet shape or a belt shape. The kneaded mixture for the insulation 120 is thereby obtained. Meanwhile, the kneaded mixture for the wire sheath 130 which additionally contains a colorant such as carbon black is formed in the same manner as for the kneaded mixture for the insulation 120.

Extruding Step

The kneaded mixture for the insulation 120 and that for the wire sheath 130 are extruded by a 115-mm extruder to cover the outer periphery of the conductor 110. The insulation 120 and the wire sheath 130 respectively having predetermined thicknesses are formed so as to cover the outer periphery of the conductor 110. An intermediate product of the electric wire 10 is thereby formed.

Cross-Linking Step

Next, the intermediate product of the electric wire 10 is placed in a steam tube at a predetermined steam pressure for a predetermined period of time. The insulation 120 and the wire sheath 130 are thereby cross-linked. The electric wire 10 is formed through the steps described above.

(3) Effects of the First Embodiment

The first embodiment achieves one or plural effects described below.

(a) In the first embodiment, as a result of intense study by the present inventors, the electric wire 10, which deflects not less than 180 mm in a predetermined deflection test and does not crack or is not broken in a predetermined low-temperature bend test, was achieved for the first time ever when the cross-sectional area of the conductor is not less than 180 $mm^2$ and not more than 220 $mm^2$. The electric wire 10 which deflects not less than 180 mm has a small allowable bending radius and thus cab be bent and laid even in a narrow space. In addition, no occurrence of cracks or breaks in the low-temperature bend test means that local damage causing deterioration in performance of the electric wire 10 can be prevented even when the electric wire 10 is used in a low-temperature environment. As such, in the first embodiment, it is possible to provide the electric wire 10 with improved flexibility and low-temperature bending properties.

(b) In the first embodiment, the conductor 110 is configured that not less than thirty-seven child twisted wires each formed by twisting not less than thirty-four strands with an outer diameter of not more than 0.46 mm are twisted into a parent twisted wire, and the outer diameter of the conductor 110 is not less than 19.1 mm and not more than 23.3 mm. In addition, the insulation 120 and the wire sheath 130 have a Shore A hardness of not more than 88. By forming the conductor 110 to have such a configuration and configuring the insulation 120 and the wire sheath 130 to have the above-defined hardness, it is possible to satisfy the predetermined properties in the deflection test and the low-temperature bend test.

(c) In the first embodiment, the insulation 120 and the wire sheath 130 are formed of the resin composition in which the base resin contains 100 parts by weight in total of a chlorinated polyethylene with a chlorine content of not less than 30% and not more than 45% in an amount of not less than 20 parts by weight and not more than 60 parts by weight and a polyolefin resin other than the chlorinated polyethylene.

In case of conventional CV cables having a cross-linked polyethylene insulation and a polyvinyl chloride wire sheath, it is difficult to satisfy the above-mentioned predetermined properties in the deflection test and the low-temperature bend test and is further difficult to simultaneously satisfy desired flame retardancy, heat resistance and elongation characteristics. The CV cable could be made flexible by changing the compositions of the insulation and the wire sheath but, even in such a case, it is still difficult to simultaneously improve flame retardancy, heat resistance and elongation characteristics.

In contrast, in the first embodiment, use of the resin composition containing the above-mentioned base resin allows the insulation 120 and the wire sheath 130 to have a Shore A hardness of not more than 88. Thus, by combination with the above-mentioned configuration of the conductor 110, it is possible to satisfy the predetermined properties in the deflection test and the low-temperature bend test. In addition, by using the resin composition containing the above-mentioned base resin to form the insulation 120 and the wire sheath 130, it is possible to improve flexibility and low-temperature bending properties and, at the same time, it is also possible to improve flame retardancy, heat resistance and elongation characteristics in a well-balanced manner.

(d) In the first embodiment, the polyolefin resin other than the CPE, which is contained in the base resin, is an ethylene-vinyl acetate copolymer (EVA) which is a low-crystalline polymer. Therefore, use of EVA allows the electric wire 10 to have flexibility.

(e) In the first embodiment, the content of the hydrotalcite as a stabilizer is, e.g., not less than 3 parts by weight and not more than 30 parts by weight per 100 parts by weight of the base resin. It is possible to improve heat resistance of the electric wire 10 since the hydrotalcite content is not less than 3 parts by weight. In addition, it is possible to improve elongation characteristics of the electric wire 10 since the hydrotalcite content is not more than 30 parts by weight.

(f) In the first embodiment, the child twisted wires of the conductor 110 are bunch-stranded wires and the parent twisted wire of the conductor 110 is a concentric-stranded wire. In this configuration, concentric stranding of the parent twisted wire prevents the strands of the child twisted wires from unraveling. Therefore, it is possible to obtain both flexibility of the conductor 110 and electrical characteristics of the electric wire 10.

Second Embodiment of the Invention

Figure 3:
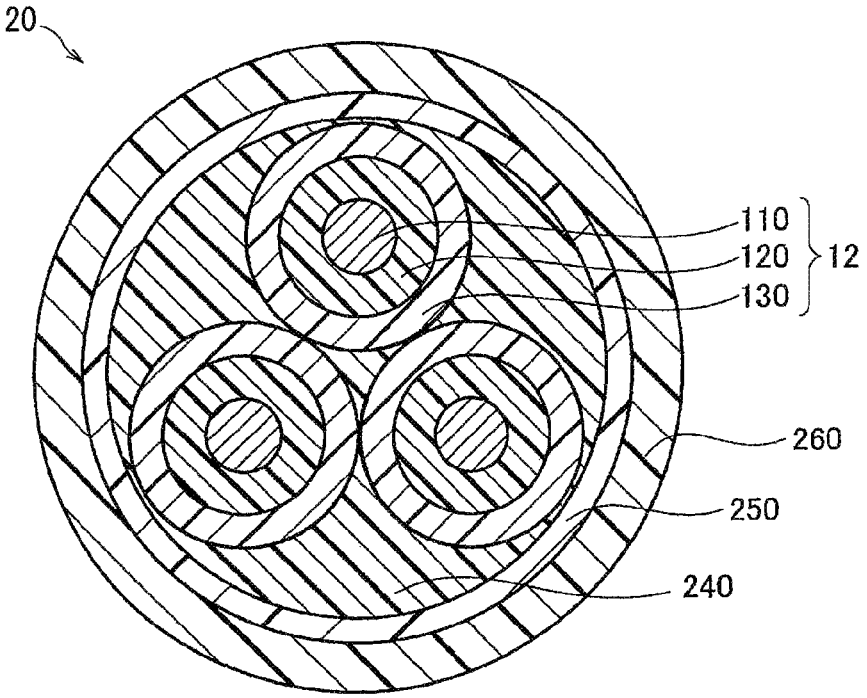
FIG. 3 is a cross sectional view orthogonal to an axial direction, showing a cable in a second embodiment of the invention.

The second embodiment of the invention will be described in reference to FIG. 3. FIG. 3 is a cross sectional view orthogonal to an axial direction, showing a cable in the second embodiment.

The second embodiment is different from the first embodiment in that it is a cable composed of plural electric wires. Only different constituent elements from those in the first embodiment will be described below. Then, constituent elements substantially the same as those explained in the first embodiment are denoted by the same reference numerals and the explanation thereof will be omitted.

As shown in FIG. 3, a cable 20 has plural electric wires 12 configured in the same manner as the first embodiment. The conductor 110 in the second embodiment is configured in the same manner as that in the first embodiment, and the insulation 120 and the wire sheath 130 in the second embodiment are formed of the same resin composition as that described in the first embodiment. Therefore, each electric wire 12 used in the cable 20 deflects not less than 180 mm in the deflection test and does not crack or is not broken in the low-temperature bend test.

In the second embodiment, the cable 20 has, e.g., three electric wires 12. The three electric wires 12 are twisted to each other.

A filler 240 is provided so as to cover the outer periphery of the electric wires 12. The filler 240 is, e.g., a paper, etc., which is twisted together with the electric wires 12.

A binding tape 250 is wound so as to cover the outer periphery of the filler 240. The binding tape 250 is formed of, e.g., PET, polyethylene or cloth, etc. The filler 240 and the binding tape 250 may not be used.

Then, a cable sheath 260 is provided so as to cover the outer periphery of the binding tape 250. The cable sheath 260 in the second embodiment is formed of, e.g., the same resin composition as that used for the wire sheath 130.

In the second embodiment, by using plural electric wires 12 which are configured in the same manner as the first embodiment, it is possible to provide the cable 20 with improved flexibility and low-temperature bending properties.

Third Embodiment of the Invention

Figure 4:
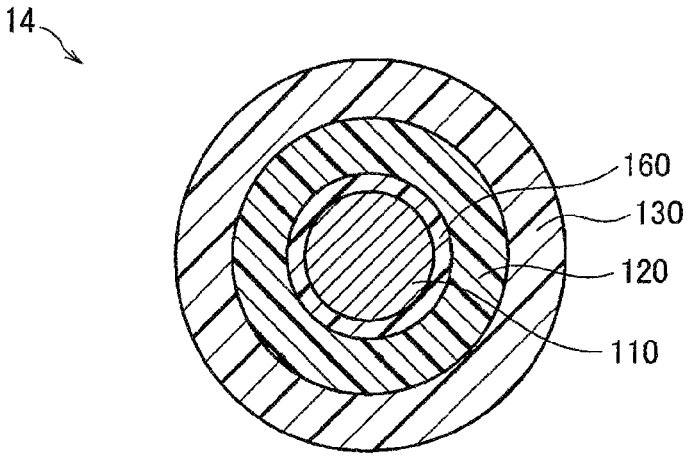
FIG. 4 is a cross sectional view orthogonal to an axial direction, showing an electric wire in a third embodiment of the invention.

The third embodiment of the invention will be described in reference to FIG. 4. FIG. 4 is a cross sectional view orthogonal to an axial direction, showing an electric wire in the third embodiment.

The third embodiment is different from the first embodiment in that a separator is provided. Only different constituent elements from those in the first embodiment will be described below. Then, constituent elements substantially the same as those explained in the first embodiment are denoted by the same reference numerals and the explanation thereof will be omitted.

As shown in FIG. 4, an electric wire 14 has the conductor 110 having a cross-sectional area of not less than 180 $mm^2$ and not more than 220 $mm^2$, a separator 160 provided so as to cover the outer periphery of the conductor 100, the insulation 120 provided so as to cover the outer periphery of the separator 160, and the wire sheath 130 provided so as to cover the outer periphery of the insulation 120. The conductor 110 in the third embodiment is configured in the same manner as that in the first embodiment, and the insulation 120 and the wire sheath 130 in the third embodiment are formed of the same resin composition as that described in the first embodiment.

The separator 160 is formed of, e.g., a polyester tape or a nylon tape. Since the separator 160 is interposed between the conductor 110 and the insulation 120, it is easy to strip the insulation 120 and the wire sheath 130 at an end of the electric wire 14.

The electric wire 14 of the third embodiment deflects not less than 180 mm in the deflection test and does not crack or is not broken in the low-temperature bend test in the same manner as the first embodiment.

In the third embodiment, the electric wire 14 can achieve similar flexibility and low-temperature bending properties to those of the electric wire 10 in the first embodiment even though the separator 160 is provided.

Other Embodiments of the Invention

Although some embodiments of the invention have been described in detail, the invention is not to be limited thereto and modifications can be appropriately implemented without departing from the gist of the invention.

Although the separator 160 provided in the electric wire 14 has been described in the third embodiment, a separator may be interposed between the conductor and the insulation in the same cable as that in the second embodiment.

EXAMPLES

Next, Examples of the invention will be described.

Samples 1 to 14 were made as described below and predetermined evaluations were conducted for each Sample.

Manufacture of Samples

Samples 1 to 5

Using Sample 1, a wire sample and a sheet sample were made in accordance with in Tables 1 and 2 below. Firstly, thirty-four strands, each formed of a tin-plated soft copper wire having a diameter of 0.45 mm, were prepared. Next, a child twisted wire was formed by bunch-stranding the thirty-four strands. Then, a parent twisted wire was formed by concentrically stranding thirty-seven child twisted wires. A conductor having a cross-sectional area of 200 $mm^2$ and an outer diameter of 21.2 mm was thereby formed. In Tables 1 to 3 below, "For forming Child twisted wire (number)" means the number of strands used to form a child twisted wire, and "For forming Parent twisted wire (number)" means the number of the child twisted wires used to form a parent twisted wire.

Next, the components shown in Tables 1 and 2, except the cross-linking agent, were mixed and kneaded by a pressure kneader at a start temperature of 40° C. and an end temperature of 120° C. Next, a cross-linking agent was added and the mixture was then kneaded at 100° C. for 5 minutes. Next, the kneaded mixture was formed into a pellet shape or a belt shape. The kneaded mixture for the insulation was thereby obtained. Meanwhile, the kneaded mixture for the wire sheath which additionally contains a predetermined about of carbon black as a colorant was formed in the same manner as for the kneaded mixture for the insulation.

For forming the wire sample using Sample 1, the kneaded mixture for the insulation and that for the wire sheath were extruded by a 115-mm extruder to cover the outer periphery of the conductor. A 2.5 mm-thick insulation and a 1.9 mm-thick wire sheath were formed so as to cover the outer periphery of the conductor. An intermediate product of the wire sample was thereby formed. Next, the intermediate product of the wire sample was placed in a steam tube at a steam pressure of 15 $kg/cm^2$ to cross-link the insulation and the wire sheath. The wire sample using Sample 1 was thereby obtained.

Meanwhile, for forming the sheet sample using Sample 1, the kneaded mixture for the insulation and that for the wire sheath were rolled into a sheet shape by a 6-inch open roll mill. Next, using a pressing machine, the kneaded mixtures in a sheet form were pressed to a predetermined thickness at 180° C. for 1 minute. The sheet samples of the insulation and the wire sheath using Sample 1 were thereby obtained.

The wire samples using Samples 2 to 5 were different from the wire sample using Sample 1 in that the configuration of the conductor or the components and proportions for the resin composition constituting the insulation and the wire sheath were changed within the range defined herein, as shown in Tables 1 and 2 below. Meanwhile, the sheet samples using Samples 2 to 5 were different from the sheet sample using Sample 1 in that the components and proportions for the resin composition constituting the insulation and the wire sheath were changed within the defined range.

Samples 6 to 9

The wire samples using Samples 6 to 9 had the same conductor configuration as that of the wire sample using Sample 1 but were different from the wire sample using Sample 1 in that the components and proportions for the resin composition constituting the insulation and the wire sheath were outside the defined range, as shown in Tables 1 and 2 below. The sheet samples of Examples 6 to 9 using Samples 6 to 9 were different from the sheet sample using Sample 1 in that the components and proportions for the resin composition constituting the insulation and the wire sheath were outside the defined range.

Samples 10 to 14

The wire samples using Samples 10 and 11 used the same components and proportions as those of the wire sample using Sample 1 to form the resin composition of the insulation and the wire sheath but were different from the wire sample using Sample 1 in that the conductor configuration was outside the defined range, as shown in Table 3 below. In the sheet samples using Samples 10 and 11, the components and proportions for the resin composition constituting the insulation and the wire sheath were the same as those of the sheet sample using Sample 1.

The wire samples using Samples 12 to 14 had the same conductor configuration as that of the wire sample using Sample 1 but were different from the wire sample using Sample 1 in the components and proportions for the resin composition constituting the insulation and the wire sheath, as shown in Table 3 below. In detail, EVA in the resin composition was different from the EVA in the wire sample using Sample 1. In addition, the sheet samples using Samples 12 to 14 were different from the sheet sample using Sample 1 in the components and proportions for the resin composition constituting the insulation and the wire sheath, in the same manner as the wire samples.

Evaluation

Samples 1 to 14 were evaluated as follows.

Deflection Test

The deflection test was conducted on the wire samples using Samples 1 to 14 by the method described above. In the deflection test, the samples were regarded as "X (failed)"

when the amount of deflection was less than 180 mm, and the samples were regarded as "○ (passed)" when the amount of deflection was not less than 180 mm Low-Temperature Bend Test The low-temperature bend test was conducted on the wire samples using Samples 1 to 14 by the method described above. In the low-temperature bend test, the samples were regarded as "X (failed)" when cracks or breaks were visually observed on the bent portion, and the samples were regarded as "○ (passed)" when the state of the bend portion was visually indistinguishable from the other straight portion.

Hardness Test

A Shore A hardness was derived by conducting a hardness test in accordance with JIS K 6253 on the sheet samples using Samples 1 to 14 in a state that a sheet sample of insulation was stacked on a sheet sample of wire sheath.

Tensile Test

A tensile test in accordance with JIS C 3005 was conducted on test pieces obtained by pulling out the conductors from the wire samples using Samples 1 to 14. The samples with tensile strength of less than 10 MPa were regarded as "X (failed)", those with tensile strength of not less than 10 MPa and less than 13 MPa were regarded as "○ (passed)", and those with tensile strength of not less than 13 MPa were regarded as "◎ (excellent, passed the test easily)". Meanwhile, the samples with elongation of less than 350% in the tensile test were regarded as "X (failed)", those with elongation of not less than 350% and less than 400% were regarded as "○ (passed)", and those with elongation of not less than 400% were regarded as "◎ (excellent, passed the test easily)".

Flame-Retardant Test

Oxygen index (OI) measurement in accordance with JIS K 6269 was conducted on the sheet samples of both the insulation and the wire sheath using Samples 1 to 14. The samples with OI of less than 26 were regarded as "X (failed)", and those with OI of not less than 26 were regarded as "○ (passed)".

Heat Resistance Test

The following heat resistance test was conducted on the wire samples using Samples 1 to 14. In detail, after 30 days of aging at 160° C. using a gear oven aging tester in accordance with JIS K 6257, each test piece was obtained by pulling out the conductor from the aged wire sample. Then, the tensile test was conducted to measure elongation of the test pieces of the wire samples. The samples were regarded as "X (failed)" when an absolute value of elongation of the test piece was less than 50%, and the samples were regarded as "○ (passed)" when an absolute value of elongation of the test piece was not less than 50%.

TABLE 1

| | | | | 1 | 2 | 3 | 4 | 5 | 6 | 7 | 8 | 9 |
|---|---|---|---|---|---|---|---|---|---|---|---|---|
| Insulation | Base resin | CPE*1 | chlorine content 40%, MFR 1.2 | 30 | 30 | | 60 | 30 | 70 | 10 | 30 | 30 |
| | | CPE*2 | chlorine content 32%, MFR 1.6 | | | 30 | | | | | | |
| | | EVA*3 | VA content 40%, MFR 6.0 | 70 | 70 | 70 | 40 | 70 | 30 | 90 | 70 | 70 |
| | Stabilizer | | Hydrotalcite*4 | 10 | 10 | 10 | 10 | 10 | 3 | 30 | 2 | 35 |
| | Flame retardant | | Antimony trioxide*5 | 3 | 3 | 3 | 3 | 3 | | | | |
| | | | Magnesium hydroxide*6 | | | | | 30 | | | | |
| | Filler | | Talc*7 | | | | 15 | 15 | 15 | 15 | 15 | 15 |
| | | | Baked clay*8 | | | | 15 | 15 | 15 | 15 | 15 | 15 |
| | Cross-linking agent | | DCP (NOF Corporation) | 1 | 1 | 1 | 1 | 1 | 1 | 1 | 1 | 1 |
| | Lubricant | | Ethylenebis oleic amide*9 | 0.5 | 0.5 | 0.5 | 0.5 | 0.5 | 0.5 | 0.5 | 0.5 | 0.5 |
| | Antioxidant | | ADK STAB AO-18 (ADEKA) | 1.5 | 1.5 | 1.5 | 1.5 | 1.5 | 1.5 | 1.5 | 1.5 | 1.5 |
| Sheath | Base resin | CPE*1 | chlorine content 40%, MFR 1.2 | 30 | 30 | | 30 | 30 | 70 | 10 | 30 | 30 |
| | | CPE*2 | chlorine content 32%, MFR 1.6 | | | 30 | | | | | | |
| | | EVA*3 | VA content 40%, MFR 6.0 | 70 | 70 | 70 | 70 | 70 | 30 | 90 | 70 | 70 |
| | Stabilizer | | Hydrotalcite*4 | 10 | 10 | 10 | 10 | 10 | 3 | 30 | 2 | 35 |
| | Flame retardant | | Antimony trioxide*5 | 3 | 3 | 3 | 3 | 3 | | | | |
| | | | Magnesium hydroxide*6 | | | | | 30 | | | | |
| | Filler | | Talc*7 | | | 15 | | 15 | 15 | 15 | 15 | 15 |
| | | | Baked clay*8 | | | 15 | | 15 | 15 | 15 | 15 | 15 |
| | Cross-linking agent | | DCP (NOF Corporation) | 1 | 1 | 1 | 1 | 1 | 1 | 1 | 1 | 1 |
| | Lubricant | | Ethylenebis oleic amide*9 | 0.5 | 0.5 | 0.5 | 0.5 | 0.5 | 0.5 | 0.5 | 0.5 | 0.5 |
| | Antioxidant | | ADK STAB AO-18 (ADEKA) | 1.5 | 1.5 | 1.5 | 1.5 | 1.5 | 1.5 | 1.5 | 1.5 | 1.5 |
| | Colorant | | Carbon black*10 | 2 | 2 | 2 | 2 | 2 | 2 | 2 | 2 | 2 |
| Conductor | Strand diameter (mm)/child twisted wire (number)/parent twisted wire (number) | | | 0.45/34/37 | 0.32/45/40 | 0.45/34/37 | 0.45/34/37 | 0.45/34/37 | 0.45/34/37 | 0.45/34/37 | 0.45/34/37 | 0.45/34/37 |
| Characteristics | Amount of deflection (mm) | | | 240 | 260 | 230 | 220 | 210 | 220 | 230 | 220 | 220 |
| | | | | ○ | ○ | ○ | ○ | ○ | ○ | ○ | ○ | ○ |
| | Low-temperature bend test | | | ○ | ○ | ○ | ○ | ○ | ○ | ○ | ○ | ○ |
| | Shore A hardness | | | 71 | 71 | 76 | 75 | 88 | 80 | 82 | 80 | 83 |
| | Evaluation | | | ○ | ○ | ○ | ○ | ○ | ○ | ○ | ○ | ○ |

*1ELASLEN 401A (Showa Denko),
*2ELASLEN 301A (Showa Denko),
*3EX260 (DuPont-Mitsui Polychemicals),
*4DHT-4A (Kyowa Chemical Industry),
*5Antimony trioxide (China Minmetals),
*6Magseeds S4 (Konoshima Chemical),
*7Hi-Filler #16 (Matsumura Sangyo),
*8Translink 37 (Mitsui & Co.),
*9SLIPACKS O (Nippon Kasei Chemical),
*10Asahi Thermal FT (Asahi Carbon)

TABLE 2

| | | | | 1 | 2 | 3 | 4 | 5 | 6 | 7 | 8 | 9 |
|---|---|---|---|---|---|---|---|---|---|---|---|---|
| Insulation | Base resin | CPE*1 | chlorine content 40%, MFR 1.2 | 30 | 30 | | 60 | 30 | 70 | 10 | 30 | 30 |
| | | CPE*2 | chlorine content 32%, MFR 1.6 | | | 30 | | | | | | |
| | | EVA*3 | VA content 40%, MFR 6.0 | 70 | 70 | 70 | 40 | 70 | 30 | 90 | 70 | 70 |
| | Stabilizer | | Hydrotalcite*4 | 10 | 10 | 10 | 10 | 10 | 3 | 30 | 2 | 35 |
| | Flame retardant | | Antimony trioxide*5 | 3 | 3 | 3 | 3 | 3 | | | | |
| | | | Magnesium hydroxide*6 | | | | | 30 | | | | |
| | Filler | | Talc*7 | | | | 15 | 15 | 15 | 15 | 15 | 15 |
| | | | Baked clay*8 | | | | 15 | 15 | 15 | 15 | 15 | 15 |
| | Cross-linking agent | | DCP (NOF Corporation) | 1 | 1 | 1 | 1 | 1 | 1 | 1 | 1 | 1 |
| | Lubricant | | Ethylenebis oleic amide*9 | 0.5 | 0.5 | 0.5 | 0.5 | 0.5 | 0.5 | 0.5 | 0.5 | 0.5 |
| | Antioxidant | | ADK STAB AO-18 (ADEKA) | 1.5 | 1.5 | 1.5 | 1.5 | 1.5 | 1.5 | 1.5 | 1.5 | 1.5 |
| Sheath | Base resin | CPE*1 | chlorine content 40%, MFR 1.2 | 30 | 30 | | 30 | 30 | 70 | 10 | 30 | 30 |
| | | CPE*2 | chlorine content 32%, MFR 1.6 | | | 30 | | | | | | |
| | | EVA*3 | VA content 40%, MFR 6.0 | 70 | 70 | 70 | 70 | 70 | 30 | 90 | 70 | 70 |
| | Stabilizer | | Hydrotalcite*4 | 10 | 10 | 10 | 10 | 10 | 3 | 30 | 2 | 35 |
| | Flame retardant | | Antimony trioxide*5 | 3 | 3 | 3 | 3 | 3 | | | | |
| | | | Magnesium hydroxide*6 | | | | | 30 | | | | |
| | Filler | | Talc*7 | | | 15 | | 15 | 15 | 15 | 15 | 15 |
| | | | Baked clay*8 | | | 15 | | 15 | 15 | 15 | 15 | 15 |
| | Cross-linking agent | | DCP (NOF Corporation) | 1 | 1 | 1 | 1 | 1 | 1 | 1 | 1 | 1 |
| | Lubricant | | Ethylenebis oleic amide*9 | 0.5 | 0.5 | 0.5 | 0.5 | 0.5 | 0.5 | 0.5 | 0.5 | 0.5 |
| | Antioxidant | | ADK STAB AO-18 (ADEKA) | 1.5 | 1.5 | 1.5 | 1.5 | 1.5 | 1.5 | 1.5 | 1.5 | 1.5 |
| | Colorant | | Carbon black*10 | 2 | 2 | 2 | 2 | 2 | 2 | 2 | 2 | 2 |
| Conductor | Strand diameter (mm)/child twisted wire (number)/parent twisted wire (number) | | | 0.45/ 34/37 | 0.32/ 45/40 | 0.45/ 34/37 | 0.45/ 34/37 | 0.45/ 34/37 | 0.45/ 34/37 | 0.45/ 34/37 | 0.45/ 34/37 | 0.45/ 34/37 |
| Characteristics | Tensile strength (MPa) | | | 14.8 ◎ | 15.0 ◎ | 18.2 ◎ | 18.8 ◎ | 21.0 ◎ | 20.0 ◎ | 21.0 ◎ | 19.8 ◎ | 22.4 ◎ |
| | Elongation (%) | | | 470 ◎ | 500 ◎ | 400 ◎ | 410 ◎ | 350 ○ | 380 ○ | 360 ○ | 370 ○ | 330 X |
| | Flame retrdancy | | | 29.9 ○ | 29.9 ○ | 29.9 ○ | 28.9 ○ | 31.0 ○ | 31.9 ○ | 25.8 X | 28.5 ○ | 30.9 ○ |
| | Heat resistiance | | | ○ | ○ | ○ | ○ | ○ | X | ○ | X | ○ |

*1ELASLEN 401A (Showa Denko),
*2ELASLEN 301A (Showa Denko),
*3EX260 (DuPont-Mitsui Polychemicals),
*4DHT-4A (Kyowa Chemical Industry),
*5Antimony trioxide (China Minmetals),
*6Magseeds S4 (Konoshima Chemical),
*7Hi-Filler #16 (Matsumura Sangyo),
*8Translink 37 (Mitsui & Co.),
*9SLIPACKS O (Nippon Kasei Chemical),
*10Asahi Thermal FT (Asahi Carbon)

TABLE 3

| | | | | 10 | 11 | 12 | 13 | 14 |
|---|---|---|---|---|---|---|---|---|
| Insulation | Base resin | CPE*1 | chlorine content 40%, MFR 1.2 | 30 | 30 | | 20 | 30 |
| | | EVA*2 | VA content 28%, MFR 6.0 | 70 | 70 | | | |
| | | EVA*3 | VA content 17%, MFR 0.8 | | | 100 | 80 | 70 |
| | Stabilizer | | Hydrotalcite*4 | 10 | 10 | 10 | 10 | 10 |
| | Flame retardant | | Antimony trioxide*5 | 3 | 3 | 3 | 3 | 3 |
| | Filler | | Talc*6 | | | | 15 | 30 |
| | | | Baked clay*7 | | | | 15 | 30 |
| | Cross-linking agent | | DCP (NOF Corporation) | 1 | 1 | 1 | 1 | 1 |
| | Lubricant | | Ethylenebis oleic amide*8 | 0.5 | 0.5 | 0.5 | 0.5 | 0.5 |
| | Antioxidant | | ADK STAB AO-18 (ADEKA) | 1.5 | 1.5 | 1.5 | 1.5 | 1.5 |
| Sheath | Base resin | CPE*1 | chlorine content 40%, MFR 1.2 | 30 | 30 | | 20 | 30 |
| | | EVA*2 | VA content 28%, MFR 6.0 | 70 | 70 | | | |
| | | EVA*3 | VA content 17%, MFR 0.8 | | | 100 | 80 | 70 |
| | Stabilizer | | Hydrotalcite*4 | 10 | 10 | 10 | 10 | 10 |
| | Flame retardant | | Antimony trioxide*5 | 3 | 3 | 3 | 3 | 3 |
| | Filler | | Talc*6 | | | | 15 | 30 |
| | | | Baked clay*7 | | | | 15 | 30 |
| | Cross-linking agent | | DCP (NOF Corporation) | 1 | 1 | 1 | 1 | 1 |
| | Lubricant | | Ethylenebis oleic amide*8 | 0.5 | 0.5 | 0.5 | 0.5 | 0.5 |
| | Antioxidant | | ADK STAB AO-18 (ADEKA) | 1.5 | 1.5 | 1.5 | 1.5 | 1.5 |
| | Colorant | | Carbon black*9 | 2 | 2 | 2 | 2 | 2 |

TABLE 3-continued

| | | 10 | 11 | 12 | 13 | 14 |
|---|---|---|---|---|---|---|
| Conductor | Strand diameter (mm)/child twisted wire (number)/parent twisted wire (number) | 1.0/10/28 | 2.60/37/0 | 0.45/34/37 | 0.45/34/37 | 0.45/34/37 |
| Characteristics | Amount of deflection (mm) | 90 | 75 | 160 | 160 | 170 |
| | | X | X | X | X | X |
| | Low-temperature bend test | ○ | ○ | ○ | ○ | ○ |
| | Shore A hardness | 71 | 71 | 92 | 90 | 91 |
| | Evaluation | X | X | X | X | X |

*[1]ELASLEN 401A (Showa Denko),
*[2]EX260 (DuPont-Mitsui Polychemicals),
*[3]V5274 (DuPont-Mitsui Polychemicals),
*[4]DHT-4A (Kyowa Chemical Industry),
*[5]Antimony trioxide (China Minmetals),
*[6]Hi-Filler #16 (Matsumura Sangyo),
*[7]Translink 37 (Mitsui & Co.),
*[8]SLIPACKS O (Nippon Kasei Chemical),
*[9]Asahi Thermal FT (Asahi Carbon)

Evaluation Results

Firstly, referring to Tables 1 and 3, the results of flexibility and low-temperature bending properties as basic characteristics will be described.

In Samples 1 to 9, the diameter of the strands constituting the conductor was not more than 0.46 mm, the child twisted wire was formed by twisting not less than thirty-four strands together and the parent twisted wire was formed by twisting not less than thirty-seven child twisted wires together, as shown in Table 1. Meanwhile, since the insulation and the wire sheath were formed of the resin composition composed of the predetermined components in the defined proportions, the Shore A hardness of the insulation and the wire sheath was not more than 88. As a result, the wire samples using Samples 1 to 9 deflected not less than 180 mm in the deflection test and did not crack and were not broken in the low-temperature bend test. This shows that flexibility and low-temperature bending properties of Samples 1 to 9 were improved.

Now, referring to Tables 1 and 3, the configuration of the conductor in Samples 1 to 9 is compared to that in Samples 10 and 11. In Samples 10 and 11 in which the diameter of the strands constituting the conductor was more than 0.46 mm and the twisting structure of the conductor was changed, the amount of deflection was less than 180 mm in the deflection test. It is considered that this is because the wire samples were less likely to deflect (became rigid) due to the large thickness of the conductor. This shows that it is exemplary to use a conductor strand having a diameter of not more than 0.46 mm, to form a child twisted wire by twisting not less than thirty-four of such strands, and to form a parent twisted wire by twisting not less than thirty-seven of such child twisted wires.

Referring to Tables 1 to 3, the hardness of the insulation and the wire sheath in Samples 1 to 9 is compared to that in Samples 12 to 14. In Samples 12 to 14, the Shore A hardness of the insulation and the wire sheath was more than 88, and the amount of deflection was less than 180 mm in the deflection test. It is considered that, since the VA content in the EVA contained in the resin composition constituting the insulation and the wire sheath was less than 25%, the Shore A hardness of the insulation and the wire sheath exceeded 88 and the wire samples were thus less likely to deflect (became rigid). This shows that a exemplary Shore A hardness of the insulation and the wire sheath is not more than 88.

Next, the results of flame retardancy, heat resistance and elongation characteristics will be described in reference to Table 2.

As shown in Table 2, the resin compositions of Samples 1 to 5 contain the based resin containing 100 parts by weight in total of a chlorinated polyethylene with a chlorine content of not less than 30% and not more than 45% in an amount of not less than 20 parts by weight and not more than 60 parts by weight and a polyolefin resin other than the chlorinated polyethylene, not less than 3 parts by weight and not more than 30 parts by weight of a stabilizer containing hydrotalcite and not less than 1 part by weight and not more than 5 parts by weight of a flame retardant containing antimony trioxide. As a result, the wire samples using Samples 1 to 5 passed the flame retardant test, the heat resistance test and the tensile test. This shows that flame retardancy, heat resistance and elongation characteristics of Samples 1 to 5 were improved.

Referring to Table 2, the CPE content in Samples 1 to 5 is compared to that in Samples 6 and 7. Sample 6 with the CPE content of more than 60 parts by weight was rated "failed" for heat resistance. Meanwhile, Sample 7 with the CPE content of less than 20 parts by weight had a tendency to have low elongation characteristics and also was rated "failed" for flame retardancy. This shows that a exemplary CPE content is not less than 20 parts by weight and not more than 60 parts by weight.

Referring to Table 2, the content of hydrotalcite as a stabilizer in Samples 1 to 5 is compared to that in Samples 8 and 9. Sample 8 with the hydrotalcite content of less than 3 parts by weight was rated "failed" for heat resistance. Meanwhile, Sample 9 with the hydrotalcite content of less than 30 parts by weight was rated "failed" for elongation characteristics. This shows that a exemplary hydrotalcite content is not less than 3 parts by weight and not more than 30 parts by weight.

Based on the results of Examples, it was confirmed that, according to the invention, it is possible to provide an electric wire and a cable of which flexibility and low-temperature bending properties are improved and, at the same time, flame retardancy, heat resistance and elongation characteristics are also improved.

EXEMPLARY EMBODIMENTS OF THE INVENTION

The exemplary embodiments of the invention will be described blow.

[1] An embodiment of the invention provides an electric wire, comprising:

a conductor having a cross-sectional area of not less than 180 $mm^2$ and not more than 220 $mm^2$;

an insulation provided so as to cover the outer periphery of the conductor; and a wire sheath provided so as to cover the outer periphery of the insulation, wherein the amount of deflection is not less than 180 mm when, at 23° C., one end of the electric wire is fixed to a fixture table so that another end horizontally protrudes 400 mm from the fixture table and a weight of 2 kg is attached to the other end, and cracks and breaks do not occur when wound with a bending diameter of three times the diameter at −40° C.

[2] In the electric wire according to [1], exemplarily, the conductor comprises a parent twisted wire that is formed by twisting not less than 37 child twisted wires each formed by twisting not less than 34 strands having a diameter of not more than 0.46 mm, the outer diameter of the conductor is not less than 19.1 mm and not more than 23.3 mm, and the insulation and the sheath have a Shore A hardness of not more than 88.

[3] In the electric wire according to [1] or [2], the insulation and the wire sheath exemplarily comprise a resin composition comprising a base resin that contains 100 parts by weight in total of a chlorinated polyethylene with a chlorine content of not less than 30% and not more than 45% in an amount of not less than 20 parts by weight and not more than 60 parts by weight and a polyolefin resin other than the chlorinated polyethylene.

[4] In the electric wire according to [3], the resin composition exemplarily comprises a flame retardant comprising antimony trioxide and a stabilizer comprising hydrotalcite.

[5] In the electric wire according to [3] or [4], the polyolefin resin is exemplarily an ethylene-vinyl acetate copolymer.

[6] In the electric wire according to [5], a vinyl acetate content in the ethylene-vinyl acetate copolymer is exemplarily not less than 25% and not more than 35%.

[7] In the electric wire according to [3] to [6], the resin composition exemplarily comprises a stabilizer comprising hydrotalcite in an amount of not less than 3 parts by weight and not more than 30 parts by weight per 100 parts by weight of the base resin.

[8] In the electric wire according to [3] to [7], exemplarily, an oxygen index in a flame retardant test in accordance with JIS K 6269 is not less than 26, elongation is not less than 50% after 30 days of aging at 160° C. using a gear oven aging tester in accordance with JIS K 6257, and elongation is not less than 350% in a tensile test in accordance with JIS C 3005.

[9] In the electric wire according to [8], a tensile strength is exemplarily not less than 13 MPa in a tensile test in accordance with JIS C 3005.

[10] In the electric wire according to [1] to [9], exemplarily, the child twisted wire comprises a bunch-stranded wire and the parent twisted wire comprises a concentric-stranded wire.

[11] An embodiment of the invention provides a cable comprising:

a plurality of the electric wires according to [1] to [10] that are twisted together.

What is claimed is:

1. An electric wire, comprising:

a conductor having a cross-sectional area of not less than 180 $mm^2$ and not more than 220 $mm^2$;

an insulation provided so as to cover an outer periphery of the conductor, and a wire sheath provided so as to cover an outer periphery of the insulation, wherein the conductor comprises a parent twisted wire that is formed by twisting not less than 37 child twisted wires each formed by twisting not less than 34 strands having a diameter of not more than 0.46 mm, wherein an amount of deflection is not less than 180 mm when, at 23° C., one end of the electric wire is fixed to a fixture table so that an other end of the electric wire horizontally protrudes 400 mm from the fixture table and a weight of 2 kg is attached to the other end, and cracks and breaks do not occur when wound with a bending diameter of three times a diameter at −40° C., and wherein the insulation and the wire sheath comprise a resin composition comprising a base resin consisting of an ethylene-vinyl acetate copolymer and not less than 20 parts by weight and not more than 60 parts by weight of a chlorinated polyethylene with a chlorine content of not less than 30% and not more than 45%.

2. The electric wire according to claim 1, wherein an outer diameter of the conductor is not less than 19.1 mm and not more than 23.3 mm, and the insulation and the wire sheath have a Shore A hardness of not more than 88.

3. The electric wire according to claim 1, wherein the resin composition further comprises a flame retardant comprising antimony trioxide and a stabilizer comprising hydrotalcite.

4. The electric wire according to claim 1, wherein the resin composition further comprises a stabilizer comprising hydrotalcite in an amount of not less than 3 parts by weight and not more than 30 parts by weight per 100 parts by weight of the base resin.

5. The electric wire according to claim 1, wherein an oxygen index in a flame retardant test in accordance with JIS K 6269 is not less than 26, elongation is not less than 50% after 30 days of aging at 160° C. using a gear oven aging tester in accordance with JIS K 6257, and elongation is not less than 350% in a tensile test in accordance with JIS C 3005.

6. The electric wire according to claim 1, wherein at least one of the child twisted wires comprises a bunch-stranded wire and the parent twisted wire comprises a concentric-stranded wire.

7. A cable comprising a plurality of the electric wires according to claim 1 that are twisted together.

8. The electric wire according to claim 1, wherein a thickness of the insulation is not less than 1.5 mm and not more than 3.5 mm.

9. The electric wire according to claim 1, wherein a thickness of the wire sheath is not less than 1 mm and not more than 3 mm.

10. The electric wire according to claim 1, wherein an allowable bending radius of the electric wire is not less than 80 mm and not more than 150 mm.

11. The electric wire according to claim 1, wherein said each of the child twisted wires comprises a bunch-stranded wire in which all the strands are twisted in a same direction.

12. The electric wire according to claim 1, wherein the parent twisted wire comprises a concentric-stranded wire in which the child twisted wires are concentrically twisted around at least one strand.

13. The electric wire according to claim 1, wherein a vinyl acetate content in the ethylene-vinyl acetate copolymer is in a range from 25% to 35%.

* * * * *